US009475186B2

(12) United States Patent
Keng

(10) Patent No.: US 9,475,186 B2
(45) Date of Patent: Oct. 25, 2016

(54) TOOL BIT CARRIER

(71) Applicant: Shane Keng, Roswell, GA (US)

(72) Inventor: Shane Keng, Roswell, GA (US)

( * ) Notice: Subject to any disclaimer, the term of this patent is extended or adjusted under 35 U.S.C. 154(b) by 0 days.

(21) Appl. No.: 14/706,557

(22) Filed: May 7, 2015

(65) Prior Publication Data

US 2015/0321334 A1 Nov. 12, 2015

Related U.S. Application Data

(60) Provisional application No. 61/990,149, filed on May 8, 2014.

(51) Int. Cl.
*B25H 3/00* (2006.01)

(52) U.S. Cl.
CPC ..... *B25H 3/003* (2013.01)

(58) Field of Classification Search
CPC ..... B25H 3/00; B25H 3/003; B25H 3/06
USPC ..... 206/372, 373, 375–379; 211/70.6
See application file for complete search history.

(56) References Cited

U.S. PATENT DOCUMENTS

| | | | | |
|---|---|---|---|---|
| 7,168,559 | B2 * | 1/2007 | Chen | B25H 3/003 206/379 |
| 7,624,863 | B2 * | 12/2009 | Meng | B25H 3/025 206/372 |
| 7,624,866 | B2 * | 12/2009 | Wang | B25H 3/025 206/372 |
| 7,677,391 | B2 * | 3/2010 | Pistor | B25H 3/003 206/372 |
| 8,469,190 | B1 * | 6/2013 | Chang | B25H 3/003 206/372 |
| 9,126,739 | B2 * | 9/2015 | Chao-Ming | B25H 3/003 |
| 2011/0094910 | A1 * | 4/2011 | Fleury | B25H 3/003 206/372 |

* cited by examiner

*Primary Examiner* — Bryon Gehman
(74) *Attorney, Agent, or Firm* — Sutherland Asbill & Brennan LLP

(57) ABSTRACT

A bit carrier is disclosed. The bit carrier may include a first arm comprising a first end and a second end. The bit carrier also may include a second arm comprising a first end and a second end. The first end of the first arm may be rotatably attached to the first end of the second arm. In addition, the second end of the first arm may be fastenable to the second end of the second arm. Moreover, the bit carrier may include a plurality of slots disposed about the first arm and the second arm. The plurality of slots may be configured to removeably secure a plurality of bits therein.

19 Claims, 2 Drawing Sheets

TOOL BIT CARRIER

CROSS-REFERENCE TO RELATED APPLICATIONS

The present disclosure claims priority to and the benefit of U.S. provisional patent application No. 61/990,149, filed May 8, 2014, which is herein incorporated by reference in its entirety.

FIELD OF THE DISCLOSURE

The disclosure generally relates to tool bits and more particularly relates to a tool bit carrier.

BACKGROUND

Tools bits, such as screwdriver bits or the like, are used to tighten and/or remove various fasteners. Because fasteners come in many different types and sizes, a number of bits may be needed to complete a task. In this manner, a bit set with a compact and convenient storage and/or carrier case may be useful.

SUMMARY

Some or all of the above needs and/or problems may be addressed by certain embodiments of the present disclosure. According to an embodiment, a bit carrier is disclosed. The bit carrier may include a first arm comprising a first end and a second end. The bit carrier also may include a second arm comprising a first end and a second end. The first end of the first arm may be rotatably attached to the first end of the second arm. In addition, the second end of the first arm may be fastenable to the second end of the second arm. Moreover, the bit carrier may include a plurality of slots disposed about the first arm and the second arm. The plurality of slots may be configured to removeably secure a plurality of bits therein.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
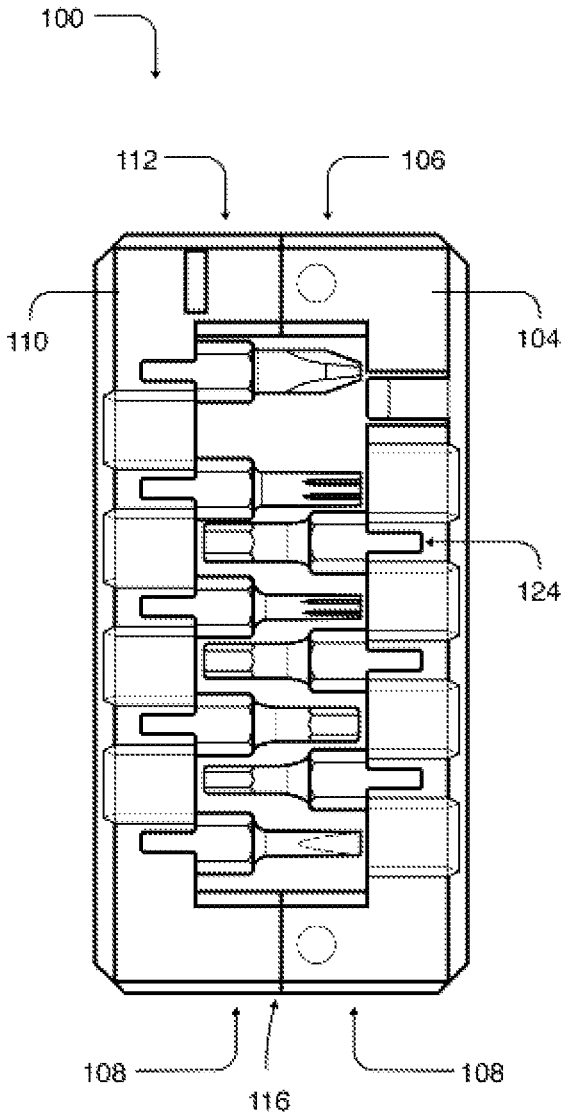
FIG. 1 is a side view of a bit carrier in accordance with one or more embodiments of the disclosure.

Illustrative embodiments of the bit carrier will now be described more fully hereinafter with reference to the accompanying drawings, in which some, but not all embodiments are shown. The bit carrier may be embodied in many different forms and should not be construed as limited to the embodiments set forth herein; rather, these embodiments are provided so that this disclosure will satisfy applicable legal requirements. Like numbers may refer to like elements throughout.

Illustrative embodiments are directed to a bit carrier 100. The bit carrier 100 may be configured to house one or more removable bits 102. That is, the bit carrier 100 may enable the storage and/or transportation of one or more bits 102. In some instances, the bits 102 may be screwdriver bits and/or power tool bits. For example, the bits 102 may comprise tools for turning (driving or removing) one or more fasteners. The bits 102 may take any form and be configured to drive or remove may different types of fasteners. In other instances, the bits 102 may be drill bits. Any type and/or combination of bits may be used herein.

In an example embodiment, the bit carrier 100 may include a first arm 104 comprising a first end 106 and a second end 108. In some instances, the first arm 104 may be generally U-shaped. For example, the first arm 104 may include a platform with transverse legs at the ends thereof. The bit carrier 100 also may include a second arm 110 comprising a first end 112 and a second end 114. In some instances, the second arm 110 also may be generally U-shaped. For example, the second arm 110 may include a platform with transverse legs at the ends thereof. The first arm 104 and the second arm 110 may be similarly shaped.

The first end 106 of the first arm 104 may be rotatably attached to the first end 112 of the second arm 110. For example, the first end 106 of the first arm 104 and the first end 112 of the second arm 110 may include a hinge, pivot, or the like. In this manner, the first arm 104 and second arm 110 may be rotated about each other.

Figure 2:
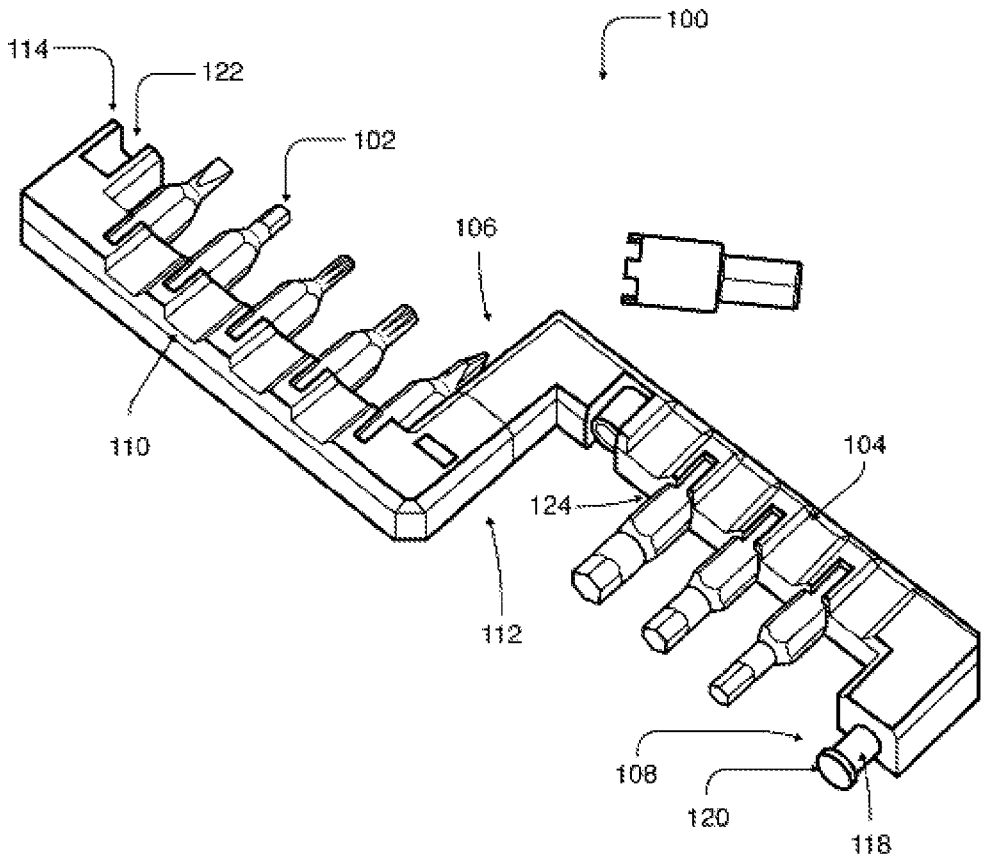
FIG. 2 is a perspective view of a bit carrier in accordance with one or more embodiments of the disclosure.

In addition, the second end 108 of the first arm 104 may be fastened to the second end 114 of the second arm 110. That is, the second end 108 of the first arm 104 and the second end 114 of the second arm 110 may include a fastener 116 configured to fasten the second end 108 of the first arm 104 to the second end 114 of the second arm 110. For example, the second end 108 of the first arm 104 may include a pin 118 with a lip 120 extending therefrom. Likewise, the second end 114 of the second arm 110 may include a corresponding groove 122 configured to mate with the pin 118 and lip 120 when the first 104 and the second arm 110 are rotated together. In this manner, the bit carrier 100 may include an open configuration (as depicted in FIG. 2) when the second end 108 of the first arm 104 and the second end 114 of the second arm 110 are unfastened and rotated apart. Likewise, the bit carrier 100 may include a closed configuration (as depicted in FIG. 1) when the second end 108 of the first arm 104 and the second end 114 of the second arm 110 are rotated together and fastened to each other.

In some instances, the fastener 116 may include a press fit. The press fit may be overcome by sufficient force from a user. For example, the fastener 116 may provide a snap or other haptic indication that the second end 108 of the first arm 104 and second end 114 of the second arm 110 have been fastened together. If the user wishes to unfasten the first arm 104 and the second arm 110, sufficient force may be applied by the user to undo the fastener 116. Other types of fasteners may be used herein, including magnetic fasteners or the like.

In some instances, a number of slots 124 may be disposed about the first arm 104 and the second arm 110. The slots 124 may be configured to removeably secure a number of bits 102 therein. In some instances, an open end of the slots 124 may face the opposing arm when the bit carrier 100 is in the closed position. For example, the slots 124 on the first arm 104 may face the second arm 110 when the bit carrier 100 is in the closed position. Similarly, the slots 124 on the second arm 110 may face the first arm 104 when the bit carrier 100 is in the closed position. In this manner, bits 102 disposed within the slots 124 may be secured in place between the first arm 104 and the second arm 110 when the bit carrier 100 is in the closed configuration. For example, the distance between the platform of the first arm 104 and the platform of the second arm 110 may be equal to or slightly larger than the length of the bits 102 when positioned within the slots 124.

The shape of the slots 124 may correspond to a shape of the bits 102. For example, the slots 124 may include a hexagonal configuration. In other instances, the slots 124 may include a 4 prong slot 126 configured to receive larger bit types. In some instances, the slots 124 may be sized to snuggly fit about the bits 102 to maintain the bits 102 in place. The bits 102 may be removed from the slots 124 when a force is applied, such as a user pulling the bits 102 from the slots 124. In some instances, the slots 124 may include one or more magnets or the like for maintaining the bits 102 within the slots 124. The slots 124 may be any size and/or shape. A number of combinations of different slot types and sizes may be used.

In certain embodiments, the slots 124 may be disposed about the first arm 104 and the second arm 110 such that at least one bit 102 extending from the first arm 104 may be disposed adjacent to at least one bit 102 extending from the second arm 110 and vice versa. That is, the slots 124 may be spaced apart from one another to fit alternating bits 102 from the opposite arm within the space between the first arm 104 and the second arm 110. In this manner, a number of bits 102 may be stored and/or transported by the bit carrier 100.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed:

1. A bit carrier, comprising:

a first arm comprising a first end and a second end;

a second arm comprising a first end and a second end, wherein the first end of the first arm is rotatably attached to the first end of the second arm, wherein the first arm and the second arm collectively comprise an open configuration and a closed configuration;

a fastener disposed about the second end of the first arm and the second end of the second arm, wherein the second end of the first arm is fastened to the second end of the second arm in the closed configuration by way of the fastener, wherein the second end of the first arm rotates away from the second end of the second arm from the closed configuration to the open configuration; and a plurality of slots disposed about the first arm and the second arm, wherein the plurality of slots are configured to removeably secure a plurality of bits therein, wherein the plurality of bits are removable from the plurality of slots in the open configuration and secured within the plurality of slots between the first arm and the second arm in the closed configuration.

2. The bit carrier of claim 1, wherein the fastener comprises a pin with a lip extending therefrom on the second end of the first arm or the second arm.

3. The bit carrier of claim 2, wherein the fastener comprises a corresponding groove on second end of the first arm or the second arm, wherein the corresponding groove is configured to mate with the pin and lip when the first arm and the second arm are rotated together.

4. The bit carrier of claim 3, wherein the pin and lip are press fit into the corresponding groove when the first arm and the second arm are rotated together.

5. The bit carrier of claim 1, wherein the plurality of bits are press fit into the plurality of slots.

6. The bit carrier of claim 1, further comprising one or more magnets disposed within the plurality of slots to maintain the plurality of bits within the plurality of slots.

7. The bit carrier of claim 1, wherein the first arm and the second arm are generally U-shaped.

8. A bit carrier, comprising:

a first arm comprising a first end and a second end;

a second arm comprising a first end and a second end, wherein the first end of the first arm is rotatably attached to the first end of the second arm, wherein the first arm and the second arm collectively comprise an open configuration and a closed configuration;

a fastener disposed about the second end of the first arm and the second end of the second arm, wherein the second end of the first arm is fastened to the second end of the second arm in the closed configuration by way of the fastener, wherein the second end of the first arm rotates away from the second end of the second arm from the closed configuration to the open configuration; and a plurality of slots disposed about the first arm and the second arm, wherein the plurality of slots are configured to removeably secure at least one bit therein, and wherein the plurality of slots are disposed about the first arm and the second arm such that at least one bit extending from the first arm is disposed adjacent to at least one bit extending from the second arm and vice versa, wherein the at least one bit is removable from the plurality of slots in the open configuration and secured within the plurality of slots between the first arm and the second arm in the closed configuration.

9. The bit carrier of claim 8, wherein the fastener comprises a pin with a lip extending therefrom on the second end of the first arm or the second arm.

10. The bit carrier of claim 9, wherein the fastener comprises a corresponding groove on second end of the first arm or the second arm, wherein the corresponding groove is configured to mate with the pin and lip when the first arm and the second arm are rotated together.

11. The bit carrier of claim 10, wherein the pin and lip are press fit into the corresponding groove when the first arm and the second arm are rotated together.

12. A bit carrier, comprising:

a first arm comprising a first end and a second end;

a second arm comprising a first end and a second end, wherein the first end of the first arm is rotatably attached to the first end of the second arm, wherein the first arm and the second arm collectively comprise an open configuration and a closed configuration;

a fastener disposed about the second end of the first arm and the second end of the second arm, wherein the second end of the first arm is fastened to the second end of the second arm in the closed configuration by way of the fastener, wherein the second end of the first arm rotates away from the second end of the second arm from the closed configuration to the open configuration; and a plurality of slots disposed about the first arm and the second arm, wherein one or more of the plurality of slots face an opposing arm when the bit carrier is in the closed position, and wherein the plurality of slots are configured to removeably secure a plurality of bits therein, wherein the plurality of bits are removable from the plurality of slots in the open configuration and secured within the plurality of slots between the first arm and the second arm in the closed configuration.

13. The bit carrier of claim 12, wherein the fastener comprises a pin with a lip extending therefrom on the second end of the first arm or the second arm.

14. The bit carrier of claim 13, wherein the fastener comprises a corresponding groove on second end of the first arm or the second arm, wherein the corresponding groove is configured to mate with the pin and lip when the first arm and the second arm are rotated together.

15. The bit carrier of claim 14, wherein the pin and lip are press fit into the corresponding groove when the first arm and the second arm are rotated together.

16. The bit carrier of claim 12, wherein the plurality of bits are press fit into the plurality of slots.

17. The bit carrier of claim 12, further comprising one or more magnets disposed within the plurality of slots to maintain the plurality of bits within the plurality of slots.

18. The bit carrier of claim 12, wherein the first arm and the second arm are generally U-shaped.

19. The bit carrier of claim 12, wherein the plurality of slots are disposed about the first arm and the second arm such that at least one bit of the plurality of bits extending from the first arm is disposed adjacent to at least one bit of the plurality of bits extending from the second arm and vice versa.

* * * * *